United States Patent [19]

Ellis

[11] 3,958,717

[45] May 25, 1976

[54] LID CONSTRUCTION FOR A CONTAINER

[75] Inventor: Nicholas D. Ellis, Mequon, Wis.

[73] Assignee: Jos. Schlitz Brewing Company, Milwaukee, Wis.

[22] Filed: Aug. 15, 1975

[21] Appl. No.: 605,199

[52] U.S. Cl. ..... 220/268; 220/334; 220/359; 220/367

[51] Int. Cl.[2] ..... B65D 41/32

[58] Field of Search ..... 220/265, 266, 268, 359, 220/334, 337, 367; 222/541

[56] References Cited

UNITED STATES PATENTS

| | | | |
|---|---|---|---|
| 3,741,432 | 6/1973 | Werth et al. | 220/268 |
| 3,759,206 | 9/1973 | Dalli et al. | 220/268 X |
| 3,910,453 | 10/1975 | Kheusel et al. | 220/367 |

*Primary Examiner*—George T. Hall

*Attorney, Agent, or Firm*—Andrus, Sceales, Starke & Sawall

[57] ABSTRACT

A lid construction for a liquid containing can or container. The lid is provided with a pouring opening which is normally enclosed by a tab that is integrally connected to the lid by a hinge section. The tab is adapted to be pushed inwardly to an open position by downward pressure. Located radially inward of the pouring opening is a smaller vent opening which is enclosed by a vent tab, and the vent tab is integrally connected to the lid by the same hinge section that connects the pouring tab to the lid. To open the container, the consumer presses downwardly on the vent tab to vent pressure from the container and thereafter pushes downwardly on the pouring tab to expose the pouring opening.

11 Claims, 4 Drawing Figures

Fig. 1
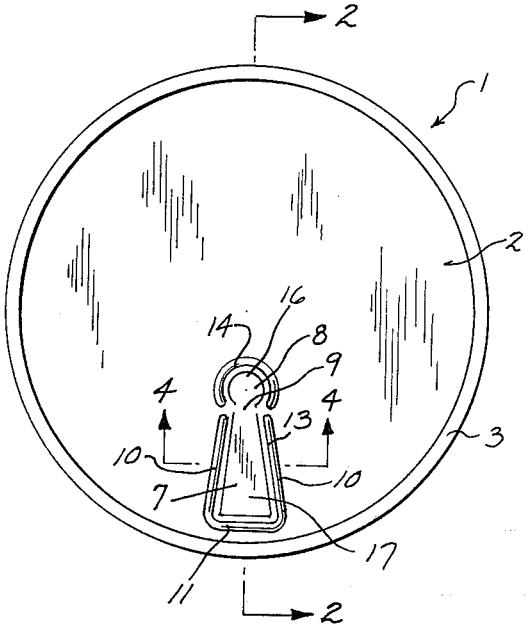
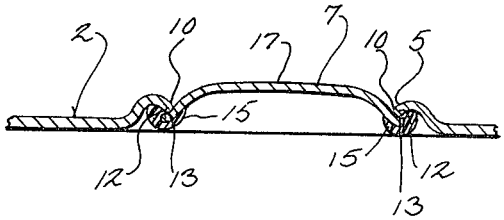
Fig. 4
Fig. 2
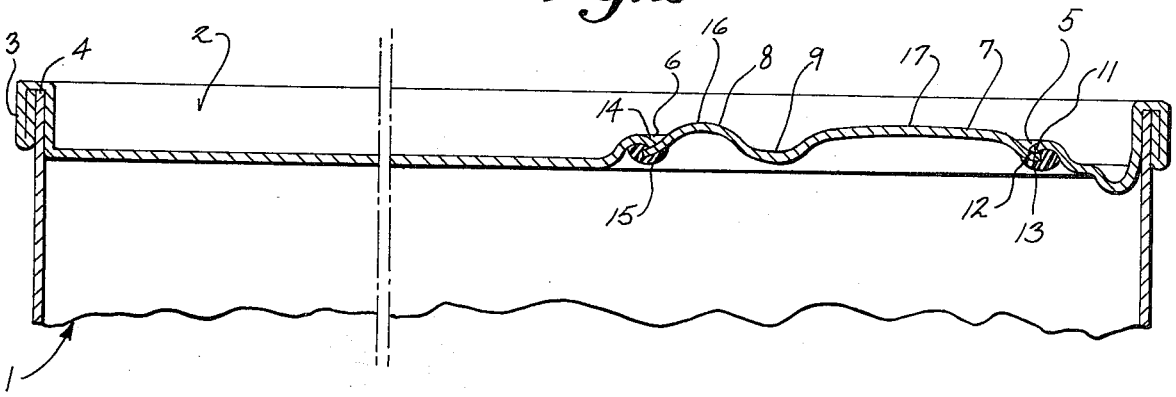
Fig. 3
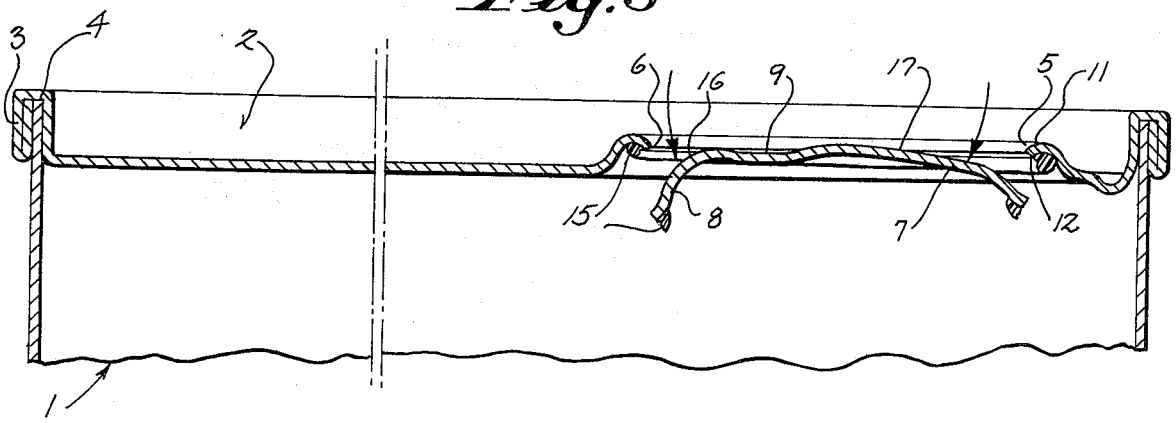

LID CONSTRUCTION FOR A CONTAINER

BACKGROUND OF THE INVENTION

The most common type of lid construction for soft drink or beer cans, is the pull-ring type in which a pull ring is secured to a removable closure or tab which normally encloses the pouring opening in the lid. By initially pivoting the ring from a horizontal position to a position generally normal to the lid, the seal will be broken to vent the pressure from the can and continued upward pulling on the ring will tear the tab from the opening. Problems have arisen in the past in that the pull ring and tab are usually discarded. Discarding of the tabs not only provides a substantial amount of litter, but also provides a hazard in that the tabs have sharp edges and cause lacerations to feet or clothing. Because of the litter problems associated with the pull tabs, legislation has been passed in certain areas of the country prohibiting the sale of cans with pull tabs.

To avoid the disadvantages of the pull tab, attempts have been made to utilize a push tab, in which the tab is pushed inwardly into the can in order to open the pouring opening. In one form of push-tab arrangement, a single hole or opening is formed in the lid of the can which is enclosed by a tab or closure. The tab can either be cut or scored through the lid with the joint sealed on the inside by a suitable adhesive or sealant, or alternately, the tab can be partially scored, in which case no internal sealant is required. As the cans usually contain either a carbonated soft drink or beer, there is a substantial internal pressure and due to the size of the pouring opening, it is very difficult to depress the tab against the internal pressure exerted by the beverage. A further disadvantage of the push-tab as used in the past is that the finger of the consumer may be pushed downwardly into the can when the tab is depressed, contacting the rough edge bordering the opening which may cause lacerations to the finger.

To facilitate opening of a push-tab attempts have been made to utilize a pair of openings in the lid of the can, one being a larger pouring hole and the second being a small vent hole. With this type of construction, the vent-tab is initially depressed to vent the internal pressure. With the internal pressure vented, the larger pouring tab can then be easily depressed to open the pouring hole. This type of construction has disadvantages in that the consumer must be educated as to the manner of opening the can, meaning that special instructions must be imprinted or embossed on the can lid indicating that the vent tab should be initially opened. As a further disadvantage, the pouring hole, in this type of construction, is often located a substantial distance from the edge of the can, making the can difficult from which to drink or pour.

SUMMARY OF THE INVENTION

The invention relates to an improved lid construction for a beverage can or container adapted to contain a carbonated beverage, such as beer or soft drinks. The lid is provided with a pouring opening located adjacent the periphery of the lid and the pouring opening is normally enclosed by a pouring tab that is integrally connected to the lid at a hinge section. The peripheral edge of the pouring tab is located beneath the edge of the lid bordering the pouring opening and is connected to the lid by a score line or weakened joint. By pushing downwardly on the pouring tab, the weakened joint will be ruptured to thereby open the pouring tab.

Located radially inward of the pouring opening is a vent opening which is normally enclosed by a vent tab that is also integrally connected to the lid by the same hinge section that connects the pouring tab in the lid. The peripheral edge of the vent tab is also joined to the lid by a scored or weakened joint.

To open the container, the consumer initially presses downwardly on the vent tab to open the vent tab and vent the pressure from the container. By pressing downwardly on the pouring tab, the pouring tab can be opened to expose the pouring opening.

With the lid construction of the invention, both the vent tab and the pouring tab are integrally connected to the lid so they will not be detached during use. This eliminates the problem of disposal of the tabs, as occurs in the case of a pull-tab type of construction.

The location and configuration of the vent tab and pouring tab on the lid is similar in appearance to the conventional pull-tab and special instructions will not be required in order to educate the consumer as to the manner of opening the tab.

As the vent tab and pouring tab are located immediately adjacent each other the can can be readily opened with a minimum of finger movement.

As the pouring opening is located immediately adjacent the periphery of the lid the contents of the can can be readily poured from the can.

Other objects and advantages will appear in the course of the following description.

DESCRIPTION OF THE DRAWINGS

The drawings illustrate the best mode presently contemplated of carrying out the invention.

In the drawings:

FIGS. 1 is a top plan view of the lid construction of the invention;

FIG. 2 is a section taken along line 2—2 of FIG. 1 and showing the tabs in the closed position;

FIG. 3 is a view similar to FIG. 2 showing the tabs in the open position; and FIG. 4 is a section taken along line 4—4 of FIG. 1.

DESCRIPTION OF THE PREFERRED EMBODIMENT

The drawings illustrate a conventional metal can or container 1 having an open end which is enclosed by a lid 2. The peripheral edge of the lid 2 is provided with a rolled chime 3 which engages the upper edge 4 of the cylindrical can 1. The can contains a liquid such as a carbonated soft drink, beer, malt liquor, or the like, which is frequently packaged under an internal pressure greater than atmospheric.

The lid 2 is provided with a pouring opening 5 which is located adjacent the periphery of the lid, and a smaller vent opening 6 that is positioned radially inward of the pouring opening. The pouring opening 5 is normally enclosed by a tab 7 which is integrally connected or hinged to the lid 2, while the vent opening 6 is enclosed by a vent tab 8 that is also integrally connected to the lid at a common hinge section 9 with the pouring tab.

The vent opening 6 is generally circular in configuration, while the pouring opening 5 is elongated and is bordered by a pair of diverging side edges 10 which are connected by an edge 11 located along the periphery of the lid. In combination, the vent tab 8, along with the pouring tab 7, give the appearance of a tab similar to that used in pull-tab type constructions.

As shown in FIGS. 2 and 4, the edges 10 and 11 of the lid bordering the pouring opening 5 are rolled downwardly to provide a relatively smooth edge of flange 12 to prevent the finger of the consumer from being cut or scraped as the pouring tab 7 is depressed. The portion of the lid bordering the vent opening can also be provided with a downwardly extending flange, similar to flange 12, but such a flange is not essential due to the fact that the consumer will nor normally insert his finger through the small vent hole 6 when depressing the vent tab 8.

The pouring tab 7 is severed from the lid along a generally U-shaped score line or joint 13, and similarly, the vent tab 8 is severed from the lid along a score line or joint 14. A bead of plastic sealing material 15 is applied to the underside of the lid to seal the joints 13 and 14 when the tabs 7 and 8 are in the closed position. The score lines 13 and 14, in combination with the sealant 15 provide a weakened zone which enables the tabs to be readily depressed by downward pressure exerted by the consumer.

As shown in FIGS. 2 and 4, the peripheral edges of the pouring tab 7 and the vent tab 8, are located beneath the edges of the lid bordering the openings 5 and 6, so that the tabs can be pushed inwardly by the consumer.

While the score lines 13 and 14 are shown in the drawings as extending completely through the thickness of the lid 2, it is contemplated that the score lines may instead extend only partially through the thickness of the lid, in which case the bead of sealant 15 would not be required, or alternately, the weakened joint can be formed by coining.

The central portion of the vent tab 8 is provided with an upwardly extending crown or dome 16 which aids in exerting pressure against the vent tab to open the same. Similarly, the central portion 17 of the pouring tab may also be crowned or domed to facilitate the opening of the pouring tab.

While the drawings illustrate the edge of the lid 2 bordering the pouring opening 5 to be bent downwardly to provide a smooth flange 12, it is contemplated that the edge of the lid bordering the pouring opening can also be doubled back in a reverse bend to provide a generally S-shaped configuration, as disclosed in U.S. Pat. No. 3,334,775. With the S-shaped configuration, the score or weakened zone is located outwardly of the edge of the lid that borders the pouring opening so that a smooth rolled edge is presented around the pouring opening.

As previously noted, the can is adapted to contain a carbonated beverage, such as beer, malt liquor, or a soft drink, which is under an internal pressure greater than atmospheric. To open the container, the consumer will initially press downwardly on the vent tab 8 rupturing the weakened zone or joint 14 and thereby enabling the pressure within the can to be vented.

The consumer will then exert downward pressure on the pouring tab 7, severing the joint or weakened zone 13 and thereby exposing the contents of the can.

With the push tab type of construction, both the vent tab and the pouring tab are integrally connected to the lid and they will at all times remain attached to the lid, thereby eliminating the problem of discarding the tabs as in the case of a pull tab construction.

By the configuration and orientation of the vent tab and pouring tab, the lid has the appearance of a conventional pull tab construction so that the consumer is more familiar with the overall appearance and special instructions as to the opening procedure are not required.

Various modes of carrying out the invention are contemplated as being within the scope of the following claims particularly pointing out and distinctly claiming the subject matter which is regarded as the invention.

I claim:

1. A lid construction for a container, comprising a lid having a vent opening and a pouring opening, said pouring opening having a substantially greater area than the vent opening and being located radially outward of said vent opening, said vent opening and pouring openings being located in proximate relation with the area between said openings defining a hinge section, a vent tab enclosing the vent opening and integrally connected to said hinge section, a severable connection connecting the edge of the vent tab to the portion of the lid bordering the vent opening, a pouring tab enclosing the pouring opening and integrally connected to the hinge section, and a second severable connection connecting the edge of the pouring tab to the portion of the lid bordering the pouring opening, said vent tab adapted to be pushed inwardly of the lid to vent the pressure in the container and said pouring tab adapted to be pushed inwardly of the lid to expose the pouring opening, said vent tab and said pouring tab remaining attached to said hinge section after being pushed inwardly of the container.

2. The lid construction of claim 1, wherein the peripheral edge of the vent tab is disposed beneath the edge of the lid bordering the vent opening and the peripheral edge of the pouring tab is disposed beneath the edge of the lid bordering the pouring opening.

3. The lid construction of claim 1, wherein the vent opening is generally circular in shape.

4. The lid construction of claim 1, wherein the pouring tab is provided with a pair of side edges which diverge in a radially outward direction and said pouring tab is provided with an end edge connecting said side edges and being located adjacent the periphery of the lid.

5. The lid construction of claim 1, wherein the edge portion of the lid bordering the pouring opening has a downwardly rolled edge.

6. The lid construction of claim 5, wherein the peripheral edge of the pouring tab is located beneath said rolled down edge.

7. A lid construction for a container, comprising a first generally U-shaped weakened zone in said lid and defining a vent tab, the ends of said first weakened zone being spaced apart at a hinge section, a second generally U-shaped weakened zone in said lid and defining a pouring tab having a substantially larger area than the vent tab, the ends of the second weakened zone being spaced apart at said hinge section, said vent tab adapted to be pushed inwardly of the lid to sever said first weakened zone and vent the pressure in the container and said pouring tab adapted to be pushed inwardly of said lid to sever said second weakened zone and expose the contents of the container.

8. The construction of claim 7, wherein said pouring tab is located radially outward of said vent tab.

9. The lid construction of claim 7, wherein said weakened zone is a score.

10. The lid construction of claim 7, wherein said weakened zone comprises a severed joint and said lid construction includes sealing means disposed across said joint on the underside of the lid.

11. A container to contain a material under an internal pressure greater than atmospheric, comprising a container body having an open end, a lid enclosing said open end and having a pouring opening located adjacent the periphery of said lid and having a vent opening located radially inward of said pouring opening, said pouring opening having a substantially greater area than said vent opening and being located in proximate relation to said vent opening with the area between said openings defining a hinge section, a vent tab enclosing the vent opening and integrally connected to the hinge section and adapted to be pivoted inwardly about said hinge connection to a location beneath the lid to thereby vent the pressure in said container body, a weakened joint connecting the peripheral edge of the vent tab to the portion of the lid bordering the vent opening, a pouring tab enclosing the pouring opening and integrally connected to the hinge section, whereby the pouring tab can be pivoted inwardly of the lid about said hinge section to expose the contents in the container body, and a second weakened joint connecting the peripheral edge of the pouring tab to the portion of the lid bordering the pouring opening, the peripheral edge of the pouring tab being located beneath said portion of the lid bordering the pouring opening.

* * * * *